US008997842B2

(12) United States Patent
Manasek

(10) Patent No.: US 8,997,842 B2
(45) Date of Patent: Apr. 7, 2015

(54) USER SELECTABLE HEAT EXCHANGE APPARATUS AND METHOD OF USE

(75) Inventor: Richard J. Manasek, Greenwood, IN (US)

(73) Assignee: AmeriFab, Inc., Indianapolis, IN (US)

( * ) Notice: Subject to any disclaimer, the term of this patent is extended or adjusted under 35 U.S.C. 154(b) by 882 days.

(21) Appl. No.: 11/741,769

(22) Filed: Apr. 30, 2007

(65) Prior Publication Data

US 2007/0277965 A1 Dec. 6, 2007

Related U.S. Application Data

(60) Provisional application No. 60/746,145, filed on May 1, 2006.

(51) Int. Cl.
*F28F 3/12* (2006.01)
*F28F 3/14* (2006.01)
*F28D 1/06* (2006.01)

(52) U.S. Cl.
CPC ..... *F28D 1/06* (2013.01)

(58) Field of Classification Search
CPC ..... F21D 1/06
USPC ..... 165/169, 170
See application file for complete search history.

(56) References Cited

U.S. PATENT DOCUMENTS

| | | | | |
|---|---|---|---|---|
| 1,774,150 | A | | 8/1930 | Murray |
| 1,844,407 | A | | 2/1932 | Murray |
| 2,239,662 | A | | 4/1941 | Bailey |
| 2,396,976 | A | | 3/1946 | Whitehurst |
| 3,294,162 | A | | 12/1966 | Loehlein et al. |
| 3,295,172 | A | | 1/1967 | Dain |
| 3,498,373 | A | * | 3/1970 | Lughausen ..... 165/169 |
| 4,033,561 | A | | 7/1977 | Dhelft |
| 4,097,679 | A | | 6/1978 | Fukumoto et al. |
| 4,122,295 | A | | 10/1978 | Nanjyo et al. |
| 4,135,575 | A | | 1/1979 | Gersch |
| 4,221,922 | A | * | 9/1980 | Okimune ..... 373/76 |
| 4,351,055 | A | | 9/1982 | Bick et al. |
| 4,453,253 | A | | 6/1984 | Lauria et al. |
| 4,455,017 | A | * | 6/1984 | Wunsche ..... 266/190 |
| 4,458,351 | A | | 7/1984 | Richards |
| 4,559,011 | A | | 12/1985 | Gritsuk et al. |
| 4,808,205 | A | | 2/1989 | Hughes et al. |

(Continued)

FOREIGN PATENT DOCUMENTS

| | | |
|---|---|---|
| EP | 01 909 161.0-2122 | 12/2004 |
| EP | 01 909 161.0-2122 | 9/2005 |
| FR | 75 39662 | 12/1975 |

(Continued)

OTHER PUBLICATIONS

The Riverside Publishing Company; New Riverside University Dictionary; Copyright 1984, 1988, 1994; Cover, Inside Cover, pp. 703 and 969.

(Continued)

*Primary Examiner* — Frantz Jules
*Assistant Examiner* — Erik Mendoza-Wilkenfel
(74) *Attorney, Agent, or Firm* — Barnes & Thornburg LLP

(57) ABSTRACT

A selectable heat exchange apparatus and method of use are provided. The heat exchange apparatus comprises a plurality of half-tubes fabricated from any selected material and in any selected method of manufacture.

12 Claims, 3 Drawing Sheets

(56) References Cited

U.S. PATENT DOCUMENTS

| | | | | |
|---|---|---|---|---|
| 6,330,269 | B1 * | 12/2001 | Manasek et al. | 373/76 |
| 8,089,999 | B2 * | 1/2012 | Manasek | 373/76 |

FOREIGN PATENT DOCUMENTS

| | | |
|---|---|---|
| GB | 1064506 | 9/1965 |
| GB | 1088827 | 9/1965 |
| GB | 2377008 | 12/2002 |
| WO | WO 01/63193 | 8/2001 |

OTHER PUBLICATIONS

Complaint for Patent Infringement, dated Aug. 13, 2004.
Answer and Counterclaims, dated Nov. 29, 2004.
Plaintiff's Reply to Defendant's Counterclaim, dated Dec. 3, 2004.
Declaration of J. V. Guy-Bray, dated Dec. 13, 2004.
Amended Complaint for Patent Infringement, dated Mar. 11, 2005.
Jonathan Midgley of Marks & Clerk; Fax regarding letter and amended pp. 2, 4, 5 and 11 to 13—European Patent Application 01909161.0; Mar. 21, 2005.
Answer to Amended Complaint and Counterclaims, dated Mar. 23, 2005.
Joint Motion for Entry of Stipulated Protective Order, dated Mar. 28, 2005.
Stipulated Protective Order, dated Mar. 30, 2005.
Order on Claim Construction, dated Jul. 29, 2005.
Motion and Answer for Leave to Amend Affirmative Defenses and Counterclaims, dated Aug. 3, 2005.
Answer to Amended Complaint with Amended Affirmative Defenses and Counterclaims, dated Sep. 2, 2005.
Declaration of R. Eric Gaum, dated Sep. 13, 2005.
Plaintiff's Reply to Defendant's Amended Counterclaims, dated Sep. 22, 2005.
Order on Motions for Summary Judgment, dated May 10, 2006.
Defendant's Motion for Partial Reconsideration and/or Clarification of the Court's Summary Judgment Ruling on Patent Invalidity, dated May 26, 2006.
Order on Defendant's Motion for Partial Reconsideration and/or Clarification of the Court's Summary Judgment Rule on Patent Invalidity, dated Jun. 2, 2006.
Stipulated Notice of Dismissal, dated Jan. 11, 2007.
Stipulated Notice of Dismissal Is Granted, dated Jan. 12, 2007.
Extended European Search Report for European Patent Application No. 07782962.0, claiming priority to PCT/US2007/067852, Mar. 17, 2011.

* cited by examiner

USER SELECTABLE HEAT EXCHANGE APPARATUS AND METHOD OF USE

This application claims priority to and the benefit of U.S. Provisional Patent Application No. 60/746,145, filed May 1, 2006, the disclosure of which is now incorporated herein by reference.

FIELD OF THE INVENTION

The present invention relates generally to protective elements, and more specifically to heat exchangers used to protect equipment.

BACKGROUND OF THE INVENTION

It is known to use cooling elements to protect equipment used in various steel industry processes. Such equipment may need to operate in extreme heat-flux conditions. Conventional cooling elements typically comprise a plurality of tubes or pipes having water running through them and which are coupled together to form the cooling elements. Such conventional tubes may for example be 2.5 inch inner diameter ("ID") cylindrical tubes having maximum water velocities through the tubes of about six (6) to seven (7) feet per second. The high heat flux conditions in which these tubes may operate make it desirable to have higher heat transfer rates and higher water velocities than the conventional 2.5 inch ID tubes can deliver. It is also desirable to be able to choose to fabricate the tubes and resulting elements from any suitable material and using any method of fabrication suitable for the material being used.

SUMMARY OF THE INVENTION

The present invention may comprise one or more of the following features and combinations thereof.

Illustratively, high heat flux resistant, fluid-cooled elements having relatively high heat transfer rates and high water velocities according to the invention are provided. It will be appreciated that the elements may have any suitable fluid such as a liquid, including for example and without limitation water running therethrough. The invention will create a means to select a wider range of materials for manufacture of user selectively shaped and designed water-cooled elements for steel industry applications. As noted, liquids or coolants other than water also fall within the scope of the invention. The elements will have the ability to better withstand the hostile and ever changing requirements in the furnaces, flue gas systems, off gas hoods, skirts, combustion chambers, drop out boxes etc. due to the inherent and improved coolant velocity within the tube(s)/element(s) and the resulting increased heat transfer capability. This invention allows for the selection of fabrication material and method of fabrication including for example and without limitation by rolling, forging, casting or extruding, as desired, to the required or desired cross-sectional radius in order to optimize the heat transfer and elasticity requirements for the particular application and without limitation to current requirements to select the tube/pipe from materials that are available on the commercial market.

The illustrative elements, which for example and without limitation may comprise a plurality of half tubes or pipes, illustratively may be selectively fabricated from various materials as desired. So, too, the elements may be fabricated using various methods of fabrication suitable for the selected material as desired. The selection of material may be based on a cost-benefit analysis taking into account for example and without limitation the cost of materials and fabrication and the performance (for example the heat transfer rates and water velocities) of the resulting tube(s) and/or element(s). The selected material illustratively may be formed into an arc, or in other words a half pipe or tube or semi-circular tube or pipe using the selected (desired) method of fabrication or manufacture. Illustrative methods of manufacture or fabrication include for example and without limitation rolling, forging, casting, drawing and/or extruding. As formed, the half tubes will have two opposing arc ends, one each at one end of the arc and at the opposite end of the arc, an inner concave face extending between the two ends, and an outer convex face extending between the two ends and opposite the concave face. The opposing arc ends and the opposing concave and convex faces will extend the length of each tube. The concave face is the inner surface or face and the convex face is the outer surface or face of the half tube. Each half tube will be coupled or attached at its arc ends to a pipe-mounting or tube-mounting surface of a plate, with the hollowed or inner surface or face of the half tube facing toward the pipe-mounting surface of the plate and the outer surface or face of the half tube facing away from the tube-mounting surface of the plate. As used herein, element(s) refers to each individual half pipe or tube making up the element(s) as well as the element(s) themselves, which comprise a plurality of tubes. The fluid coolant will run through each pipe in fluid contact with the inner surface of the tube and the tube-mounting surface of the plate. The outer surface of the tube is also known as the hot side of the half tube or half pipe.

As previously noted, the tube(s) selectively may be fabricated from any suitable material including for example and without limitation steel—including for example and without limitation stainless steel, cast steel, extruded steel and drawn steel, iron, including cast iron, nickel, including nickel alloy, as well as any other suitable element, composite or alloy including for example and without limitation aluminum-bronze alloys. In addition, the invention will allow the material selections for the tube to be selected from a wider range of flat or shaped materials, which may be rolled, forged, cast or extruded into the desired semi-circular cross section or semi-cylindrical shape, which improves the operability of the cooling element relative to the prior art circular tube and cooling elements formed therefrom. The higher heat transfer of the invention will have the effect of improving equipment longevity plus on-line reliability and up-time because the equipment will be better suited to resist the effects of the high heat flux, corrosive and abrasive atmosphere in the furnace, flue gas system or combustion chamber, and any other equipment protected by one or more assembly(s) of such element(s).

In one non-exclusive but illustrative method of fabrication a length of flat bar material (material to be selected based on the application requirement as known to those skilled in the art) will be rolled, formed, cast or extruded into a desired arc, along its length, to meet the cross-sectional area requirement of the cooling element. This cross-sectional area will be adjusted to meet the resulting coolant velocity, pressure drop and residence time in the element required to optimize the operating life of the element.

Illustratively, the entire length of the bar will have a generally consistent geometry throughout its length. The arc that is rolled, formed, cast or extruded will generally be about a 180 degree arc from end to end to simulate a half pipe/tube layout. The resulting half tube/pipe arcs can also be designed to have lips or wings on their opposing ends to allow the plurality of tubes to be welded together. The outer surface could be generally smooth or it could incorporate geometries as required for a particular application such as for example and without limitation any slag retention devices, such as ridges or splines or any indentations. Commonly owned U.S. Pat. No. 6,330,269 to Manasek et al., and commonly owned U.S. Provisional Patent Application No. 60/732,618, of Manasek filed Nov. 1, 2005, each of the disclosures of which are now expressly incorporated herein by reference, describe such illustrative geometries.

Illustratively, the plurality of half tube/pipes may be welded onto a generally flat plate to form a cooling element. The welding illustratively will be along the length of the half tube/pipe elements. In the event a winged or lipped design half tube is used a single weld illustratively will attach or couple two adjacent half tube/pipe sections to the plate and to each other.

The half tube/pipes may be connected to form an illustrative closed loop coolant circuit by having for example and without limitation 180 degree half elbows, which may for example and without limitation be rounded or mitered elbows, or as another exemplary alternative supply and return headers in the case of a single parallel flow configuration.

In the event that the resulting water cooled element requires a radius to be used in the steelmaking apparatus (e.g. water cooled duct or water cooled elements for arc furnace sidewalls) the entire element is designed to be rolled in a typical plate roll to the desired radius in a specially modified plate roll.

It will be appreciated that the half-tube configuration may decrease the thickness of the cooling element by as much as 50% compared to a circular pipe or tube element configuration. As such, the effective working volume of the apparatus to be cooled will be increased. In the alternative, the thinner design of the invention compared with existing box plate construction or full diameter tube/pipe designs, illustratively allows for one half-tube cooling element to be stacked on top of another half-tube cooling element in the device to be cooled or protected. In such a configuration, if the exterior element fails then the rear element may take over cooling of the equipment without a costly down-time intervention for repair and or change out of the damaged element.

The illustrative embodiments illustratively will allow the coolant flowing within or through the element(s) to reach velocities of at least double the velocities through conventional tubes. Coolant velocities up to and in excess of about 12 to 20 feet per second through the half pipe(s) are possible according to the invention. The illustrative embodiments will also maximize the heat transfer rate of the half-pipe half-tube/element(s) relative to the characteristics of the specific material chosen for any particular element(s).

These and other aspects of the present invention will become more apparent from the following description of the illustrative embodiment.

DESCRIPTION OF THE ILLUSTRATIVE EMBODIMENTS

Figure 1:
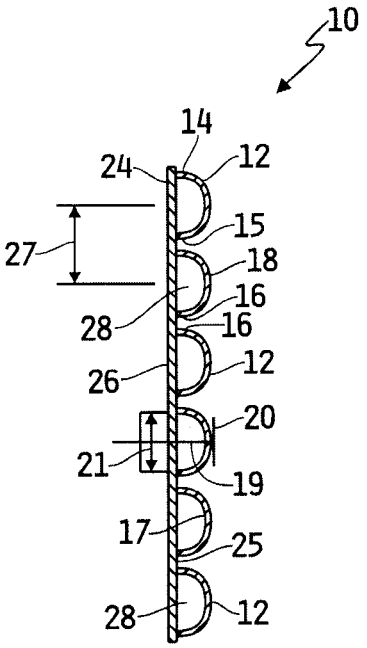
FIG. 1 depicts a cross-sectional view of an illustrative embodiment of the invention taken generally along the line 1-1 of FIG. 2.

For the purposes of promoting an understanding of the principles of the invention, reference will now be made to a number of illustrative embodiments illustrated in the drawings and specific language will be used to describe the same.

Referring to FIG. 1, a half pipe 12 or half tube 12 is formed into a desired shape such as for example and without limitation a half pipe 12 having a cross-section approximating a substantially bisected: circle or polygon, including a quadrilateral, including a parallelogram, and a hexagon or octagon in cross section. In other words, the half pipe 12 illustratively may approximate a polyhedron or cylinder substantially bisected along the plane of the diameter to form a semi-polyhedron or the depicted illustrative semi-cylindrical body 12 as will be explained. The illustrative bisected or semi-cylindrical body or half pipe 12 extends from one mounting end 14 to an opposite mounting end 15 to define an illustratively arcuate and generally concave inner surface 17 and an arcuate and generally convex outer surface 18 arcing respectively between the mounting ends 14, 15. In other words, the illustrative tube or half pipe 12 represents either half of a cylindrical body divided or substantially bisected diametrically. The opposing mounting ends 14, 15 are illustratively configured to mount or couple the half pipe 12 to for example and without limitation a mounting plate 24. It will be appreciated that the pipe 12 could be mounted directly to a piece of equipment, such as for example and without limitation a wall of a furnace. The illustrative embodiment depicted in FIG. 1 shows a plurality of pipes 12 mounted or coupled to the pipe-mounting face 25 of mounting plate 24 to form an illustrative cooling element 10, 10A, 10B, 10C. Opposite the pipe-mounting face 25 of mounting plate 24 is an equipment-mounting face 26, which illustratively is configured to mount the plate 24 to a piece of equipment.

Figure 1A:
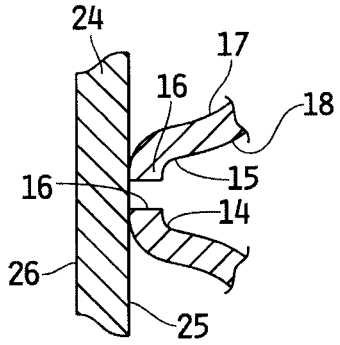
FIG. 1A depicts a fragmentary enlargement of a portion of FIG. 1.

The pipe(s) 12 may be mounted or coupled to the plate 24 in any suitable manner including for example and without limitation by welding along the length of the pipe 12 on each side or mounting end 14, 15 thereof. Any pipe mounting end 14, 15 illustratively and optionally may have an extended portion or lip 16. As best seen in FIG. 1A, when the mounting ends 14, 15 of adjacent pipes have a lip 16, a single-weld may be used to attach or couple with the plate 24 or piece of equipment those respective ends 14, 15 along their lengths. When a pipe 12 and plate 24 are coupled together, a hollow channel or conduit 28 is formed and is configured to contain therein and allow the passage therethrough of a fluid including without limitation any suitable coolant such as for example a liquid. One non-exclusive example of a suitable liquid is water. The conduit 28 may also be formed by directly mounting together pipe 12 and a piece of equipment. It will also be appreciated that the conduit 28 may be formed by forming a closed pipe 12, illustratively having a generally flat surface extending between mounting ends 14, 15 along a diametrical plane 38. Such an illustrative surface, which need not be flat or planar, could be mounted together with either a plate 24 or directly with a piece of equipment.

The tube 12 has several dimensions including without limitation an inner diameter 21 representing the length of the diametrical plane extending between mounting ends 14, 15; the inner radius 19 and the outer radius 20 respectively representing the length of a plane between a mid-point of the diametrical plane and any point on the respective inner surface 17 and outer surface 18. These dimensions 19, 20, 21 may be selected as desired. For example, and without limitation, the inner radius 19 may be about one (1) inch to about two (2) inches or more and the inner diameter 21 may be about two (2) inches to about four (4) inches or more as desired. The outer radius 20 can be selected to reflect the desired thickness of the tube wall, which would be defined by the difference between the length of inner radius 19 and the length of the outer radius 20. The distance 27 from the midpoint of one tube 12 to another 12, is depicted in FIG. 1. This distance may also be chosen as desired and is based on the dimensions chosen for the tube 12 and the distance between adjacent tubes 12. For example and without limitation, such distance 27 may range between three (3) and six (6) inches. In one illustrative embodiment, this distance may be about four (4) inches. Each tube will have a longitudinal length as well, with the longitudinal length having any desired length and illustratively being determined by the size of the equipment to be protected.

Figure 2:
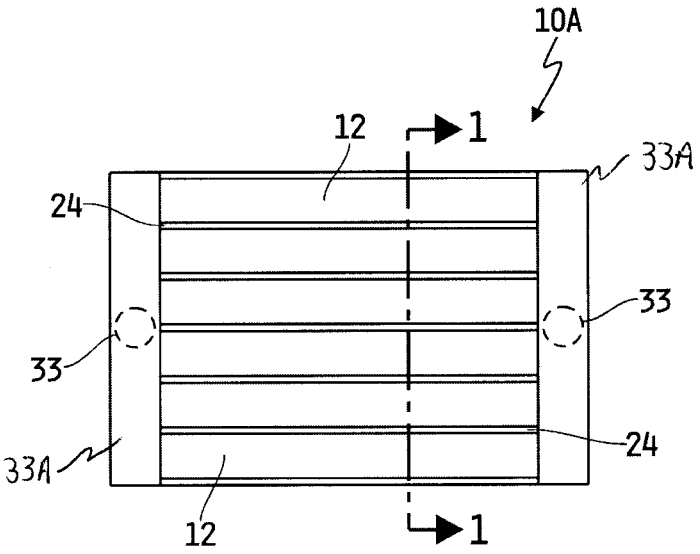
FIG. 2 depicts an illustrative top plan view of an illustrative embodiment of the invention.
Figure 3:
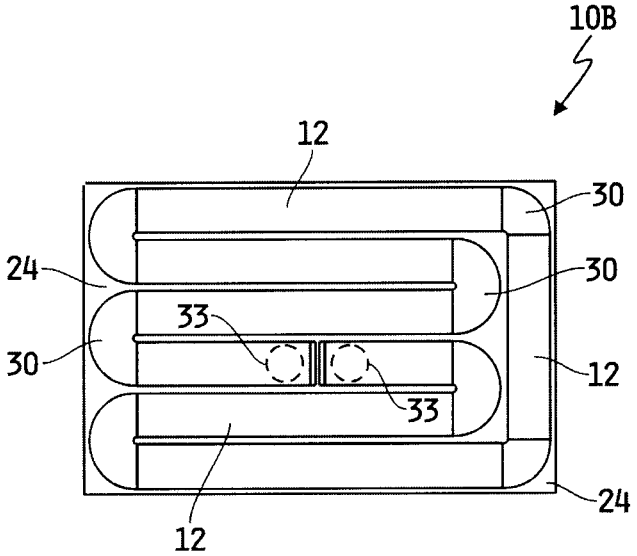
FIG. 3 depicts an illustrative top plan view of another illustrative embodiment of the invention.
Figure 4:
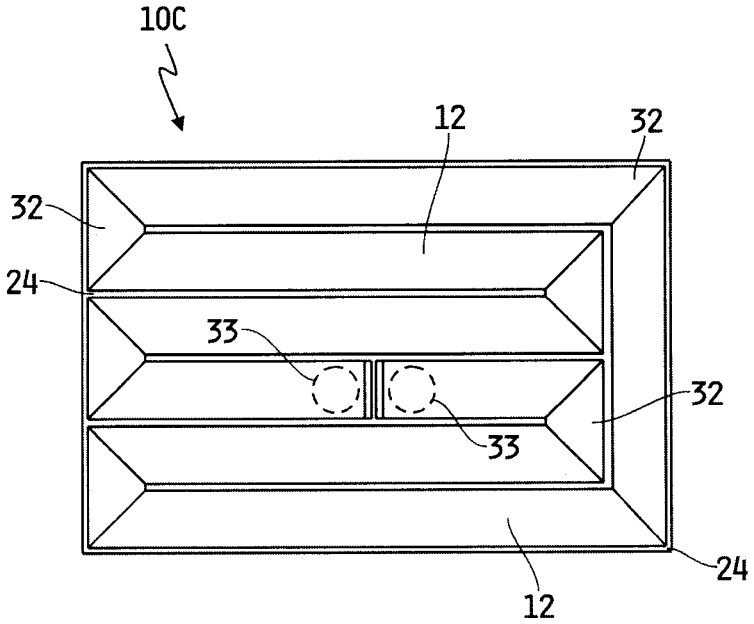
FIG. 4 depicts an illustrative top plan view of yet another illustrative embodiment of the invention.

Illustratively, the exemplary half-tube/pipes 12 may be connected to form an illustrative closed loop cooling circuit or cooling elements 10, 1A, 10B and 10C, which illustratively may be configured in a single parallel flow configuration 10A as depicted in FIG. 2 and known to those skilled in the art or a return configuration 10B, 10C as depicted in FIG. 3 and FIG. 4 respectively. In the return configuration, the tubes 12 are illustratively interconnected by connecting pieces such as for example and without limitation 180-degree half elbows 30, 32. The elbows 30, 32 illustratively may be rounded 30 as in FIG. 3, or mitered 32 as depicted in FIG. 4. The tubes/elements will be in fluid communication with supply and return sources 33. In the illustrative single parallel flow configuration 10A, the supply and return sources 33 illustratively will be in fluid communication with supply and return headers 33A.

The tube(s) 12 illustratively and selectively may be fabricated from any suitable material including for example and without limitation: steel, including for example and without limitation stainless steel, cast steel, extruded steel and drawn steel; iron, including without limitation cast iron; nickel, including without limitation nickel alloy; as well as any other suitable element, composite or alloy including for example and without limitation aluminum-bronze alloys. In addition, the invention will allow the material selections for the tube to be selected from a wider range of flat or shaped materials. In any event, the selected material of fabrication may be fabricated using any suitable method including for example and without limitation rolling, forging, casting or extruding into the desired shape including without limitation the illustrative semi-cylindrical shape.

In one non-exclusive but illustrative method of fabrication a length of flat bar material (material to be selected based on the application requirement as known to those skilled in the art) is be rolled, formed, cast or extruded into a desired arc, along its length, to meet the desired cross-sectional area requirement of the cooling element. This cross-sectional area illustratively and selectively may be adjusted to meet the resulting coolant velocity, pressure drop and residence time in the element required to optimize the operating life of the element.

Illustratively, the entire length of the bar will have a generally consistent geometry throughout its length. For example in the illustrative semi-cylindrical half pipe, the arc that is rolled, formed, cast or extruded will generally be about a 180 degree arc from end to end 14, 15 to define the illustrative half pipe/tube layout. The resulting half tube/pipe arcs 12 may but need not be designed to have lips or wings 16 on their opposing ends 14, 15 to allow the plurality of tubes to be welded together. For example, in the event that wings 16 are provided, a single weld can be used to attach together the adjacent wings 16 of adjacent tubes 12 and the mounting plate 24. It will be appreciated that tubes 12 could be disposed in close enough proximity to allow for a single-weld connection even without the use of wings 16.

Figure 5:
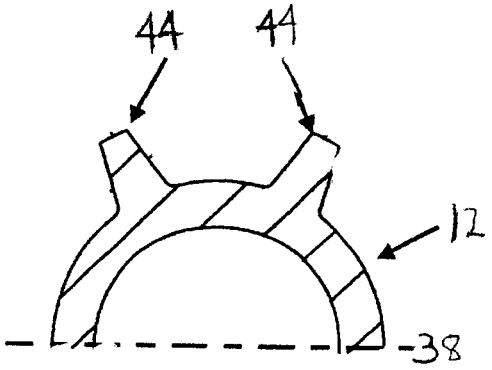
FIG. 5 depicts an illustrative cross-sectional view of another illustrative embodiment of the invention showing an anti-slag configuration.

The outer surface 18 illustratively could be generally smooth or it could incorporate geometries as required for a particular application such as for example and without limitation any slag retention devices, such as ridges or splines 44 as disclosed in the incorporated Manasek U.S. Pat. No. 6,330,269 and U.S. Provisional Patent Application No. 60/732,618 and depicted illustratively in FIG. 5. So, too, anti-slag devices and configurations, such as indentations, could be used as desired.

In the event that the resulting cooled element illustratively requires a radius to be used in the equipment/apparatus to be protected, for example and without limitation in water cooled ducts or water cooled elements for arc furnace sidewalls used in steel making, the entire element 10 may be designed to be rolled in a typical plate roll to the desired radius in a specially modified plate roll.

Those skilled in the art will appreciate that other suitable substantially bisected shapes may be used as desired. For example and without limitation a hollow and bisected, i.e., half or semi: polyhedron, hexahedron, octahedron, dodecahedron, icosahedron, square, cube, parallelepiped, prism, cone, plinth, cylinder and the like may be used as desired. As with the illustrative generally bisected half pipe 12 or semi-cylindrical hollow body, the foregoing bisected bodies could have a closed configuration to form the conduit 28, rather than having an open side with the conduit 28 being formed subsequently by mounting to a plate 24 or piece of equipment/apparatus. No matter the geometry of the generally substantially bisected half pipe 12, it will be appreciated that the illustrative bisected bodies, including the illustrative half pipe 12, described herein may decrease the thickness of the cooling element by as much as 50% compared to a non-bisected body, such as in the case of complete cylindrical or square pipe or tube element configuration. As such, the effective working volume of the equipment or apparatus to be cooled or protected will be increased. In the alternative, the thinner design of the bisected bodies of the invention compared with existing conventional box plate construction or non-bisected cylindrical tube/pipe designs, illustratively allows for one generally bisected or half-tube cooling element to be stacked on top of another generally bisected or half-tube cooling element in the apparatus/equipment/device to be cooled or protected. In such a configuration, if the exterior element, for example the one on the hot side exposed directly to molten slag in an electric arc furnace, fails, then the rear element (i.e., the one not directly exposed to the exemplary slag) may take over cooling of the equipment without a costly down-time intervention for repair and or change out of the damaged element as must happen if only one cooling element is used.

The illustrative embodiments 10, 10A, 10B, 10C will allow the coolant flowing within or through the element(s) to reach velocities of at least double the velocities through conventional tubes. Illustratively, coolant velocities up to and in excess of about 12 to 20 feet per second through the half tube(s) are possible according to the invention. The illustrative embodiments will also maximize the heat transfer rate of the tube/element(s) relative to the characteristics of the specific material chosen for any particular element(s).

Also provided is a method of protecting a piece of equipment comprising the steps of providing a protective element comprising a plurality of the above described half pipes, and attaching together the piece of equipment and the protective element, and allowing a fluid to flow through each half pipe. The half pipes may be in fluid communication with each other or in fluid communication with supply and return headers as desired. Illustratively, all desired aspects of the half pipe may be selected including for example and without limitation the shape, including the dimensions of the half pipe, the material from which the half pipe will be fabricated, the method of fabrication, and the method of attachment.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A protective apparatus for a steel making furnace comprising a first half pipe and a second half pipe, each half pipe having a longitudinal length and a shape approximating a substantially bisected geometric body, wherein each half pipe comprises opposed mounting ends defined by a plane of bisection, the opposed mounting ends having a shape deviating from the shape approximating the substantially bisected geometric body, a face falling generally along the plane of bisection and extending between the opposed mounting ends, and an outer surface generally opposite the face, the outer surface configured to directly contact but not encourage the retention of a material to be cooled, wherein the protective apparatus further comprises a plate having a first side and a second side, the first side being mounted to and facing the inside of the steel making furnace and the half pipes being mounted to the second side so that an end of the first half pipe is adjacent the end of the second half pipe whereby each half pipe outer surface is exposed to and faces the furnace interior and the hot slag material to be cooled, and further comprising one weld attaching the adjacent half pipe opposed mounting ends to the plate.

2. The protective apparatus of claim 1 wherein the half pipe is formed from any suitable elemental, alloy or composite material.

3. The protective apparatus of claim 2 wherein the half pipe is formed using any method of manufacture suitable for the material.

4. The protective apparatus of claim 3 wherein the half pipe includes heavy walls suitable for use in steel making equipment.

5. The protective apparatus of claim 4 wherein the half pipe is integrally formed.

6. A protective apparatus for protecting an interior wall of a steel making furnace comprising:

a plurality of half pipes, the half pipes approximating a substantially bisected cylindrical body having an outer surface configured to directly contact but not encourage the retention of a material to be cooled and opposed mounting ends, the opposed mounting ends having a shape deviating from the shape approximating the substantially bisected cylindrical body, a mounting plate having a pipe-mounting face and an opposed equipment mounting face, wherein the pipe-mounting face is attached together with the respective mounting ends of each of the plurality of half pipes to form a protective element with the ends of adjacent half pipes being joined to the mounting plate by a single weld, wherein the protective element is attached to the interior wall of the steel making furnace with the half pipes outer surface facing the furnace interior.

7. A method of protecting an interior wall of a steel making furnace comprising the steps of:

providing a protective element comprising a plurality of half pipes, the half pipes having a cross-sectional area approximating a generally bisected geometric body, ends extending in a plane along their length and an outer surface, the ends having a shape deviating from the shape approximating the generally bisected geometric body;

attaching the protective element to the wall of the steel making furnace, wherein the outer surface faces the furnace interior and the hot slag material to be cooled; and allowing a fluid to flow through each half pipe; and configuring the outer surface to directly contact but not encourage the retention of the hot slag material to be cooled.

8. The method of protecting a piece of equipment of claim 7 wherein the fluid flows at velocities of between about 12 feet per second and about 20 feet per second.

9. The method of protecting a piece of equipment of claim 7 further comprising the step of selecting the shape of each half pipe.

10. The method of protecting a piece of equipment of claim 7 further comprising the step of selecting the material of fabrication of each half pipe.

11. The method of protecting a piece of equipment of claim 7 further comprising the step of selecting the method of fabrication of each half pipe.

12. A protective apparatus for a steel making furnace comprising stacked cooling elements, each cooling element comprising a plate having a first side and a second side;

a half pipe having a longitudinal length and a shape approximating a substantially bisected geometric body; wherein the half pipe comprises opposed mounting ends defined by a plane of bisection, an outer surface generally opposite the mounting ends, the outer surface configured to directly contact but not encourage the retention of a material to be cooled, the mounting ends being mounted to the first side of the plate;

wherein at least two cooling elements are stacked on one another with a second cooling element being stacked on the first cooling element so that the first and second cooling elements are parallel but are not coplanar, the second cooling element being an exterior cooling element and the first cooling element being an adjacent cooling element, the plate of the first cooling element being mounted to the inside of the wall of a furnace, the second cooling element having an exposed half pipe surface facing the interior of the furnace whereby failure of the second cooling element with the half pipe exposed directly to molten slag in an electric arc furnace enables the adjacent first cooling element to take over cooling.

* * * * *